US007239283B2

(12) United States Patent
Chua

(10) Patent No.: US 7,239,283 B2
(45) Date of Patent: Jul. 3, 2007

(54) ANTENNA

(75) Inventor: Lye-Whatt Chua, Surrey (GB)

(73) Assignee: Thales PLC, Surrey (GB)

( * ) Notice: Subject to any disclaimer, the term of this patent is extended or adjusted under 35 U.S.C. 154(b) by 0 days.

(21) Appl. No.: 10/944,409

(22) Filed: Sep. 20, 2004

(65) Prior Publication Data

US 2005/0078042 A1 Apr. 14, 2005

(30) Foreign Application Priority Data

Sep. 22, 2003 (GB) ..... 0322149.6

(51) Int. Cl.
*H01Q 13/10* (2006.01)

(52) U.S. Cl. ..... 343/746; 343/700 MS; 343/792.5; 343/829

(58) Field of Classification Search ..... 343/700 MS, 343/746
See application file for complete search history.

(56) References Cited

U.S. PATENT DOCUMENTS

| | | | | |
|---|---|---|---|---|
| 2,985,879 A | | 5/1961 | Du Hamel | |
| 3,259,905 A | | 7/1966 | Stang | |
| 5,229,777 A | | 7/1993 | Doyle | 343/700 MS |
| 5,289,198 A | * | 2/1994 | Altshuler | 343/729 |
| 5,828,340 A | | 10/1998 | Johnson | 343/700 MS |
| 5,990,838 A | * | 11/1999 | Burns et al. | 343/702 |
| 6,317,089 B1 | | 11/2001 | Wilson | 343/713 |
| 6,476,766 B1 | * | 11/2002 | Cohen | 343/700 MS |
| 6,590,545 B2 | * | 7/2003 | McCorkle | 343/830 |
| 2002/0122010 A1 | | 9/2002 | McCorkle | |
| 2003/0020668 A1 | * | 1/2003 | Peterson | 343/846 |

FOREIGN PATENT DOCUMENTS

| | | |
|---|---|---|
| EP | 0 588 514 A | 3/1994 |
| GB | 1601441 | 10/1981 |
| GB | 2379088 A | 2/2003 |
| JP | 2003126919 | 5/2002 |
| WO | 8402038 A1 | 5/1984 |
| WO | 01 37372 | 11/1999 |
| WO | 02 49155 A | 6/2002 |

OTHER PUBLICATIONS

Abstract CA 1055600A Sandoz et al May 29, 1979.
Eskelinen P. Improvements of an Inverted Trapezoidal Pulse Antenna New York IEEE Antennas and Propagation Magazine Jun. 3, 2001.

* cited by examiner

*Primary Examiner*—Don Wong
*Assistant Examiner*—Binh Van Ho
(74) *Attorney, Agent, or Firm*—Lowe Hauptman & Berner, LLP

(57) ABSTRACT

There is disclosed an antenna having a tapered radiating element possessing a slow-wave structure along a tapered radiating edge thereof. The radiating element is combined with a ground plane conductor to form a monopole antenna. The slow-wave structure supports an increased antenna operating bandwidth and reduced aperture clutter by being shaped to increase the radiative rate of loss of energy from signals propagating along the slow-wave structure. A log-periodic distribution in the shaping of serrations within the slow-wave structure provides substantially frequency-independent performance across the bandwidth.

17 Claims, 4 Drawing Sheets

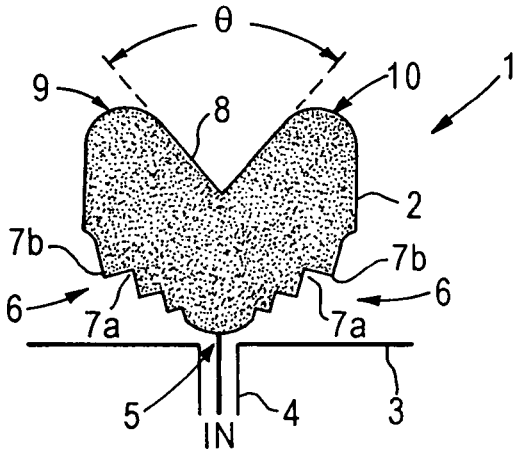
Fig. 1
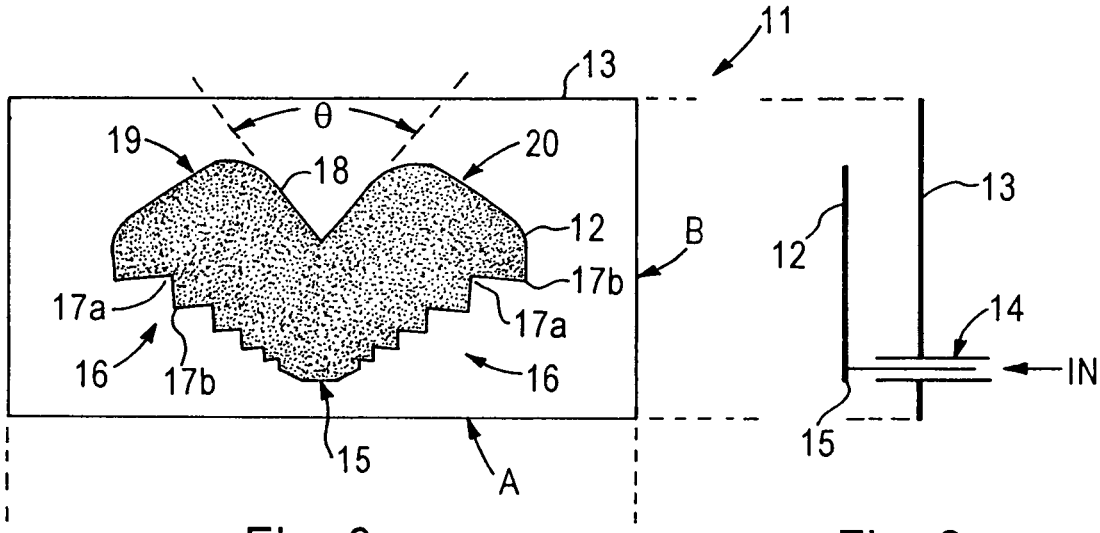
Fig. 2a
Fig. 2c
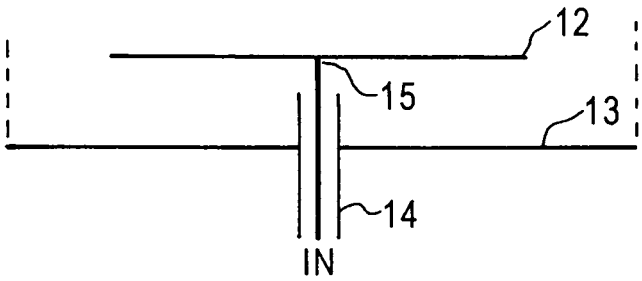
Fig. 2b

ANTENNA

RELATED APPLICATION

The present application is based on, and claims priority from, GB Application No. 0322149.6, filed Sep. 22, 2003, the disclosure of which is hereby incorporated by reference herein in its entirety.

FIELD OF THE INVENTION

The present invention relates to antennas and particularly, though not exclusively, to antennas arranged for transmitting and/or receiving brief pulses of radiation.

Pulsed electromagnetic (e/m) energy transmission and reception systems typically possess wide-band or ultra wide-band (UWB) transmission spectral band widths. This UWB characteristic stems from the pulsed nature of the e/m energy transmitted or received by such systems. The shape of such energy pulses in the time-domain is typically one of any number of approximations to a delta function, and generally has the property that the width of the frequency spectrum of such impulse increases as the time-domain "length" or duration of the pulse decreases. Thus, the more brief the pulse of radiation is the broader is its spectral bandwidth.

Thus, when an antenna is used employing such pulses in UWB applications, it is often found that the time-domain behaviour of the antenna is critical to the operation of the antenna. In particular, if an impedance mismatch or discontinuity occurs in such an antenna (such as at the open-circuit end of the antenna), the consequence is often the unwanted generation of a standing wave of e/m energy within the antenna's radiating element(s) caused by reflections within the antenna of the e/m energy to be transmitted.

This trapped energy not only reduces the efficiency of the transducer of which the antenna forms a part, but also masks, obscures or interferes with signals received by the transceiver while the trapped energy is still present within the antenna.

Thus, in any resonant structure, such as a dipole antenna, an impulse signal injected at the antenna input will typically be partially reflected from the open-circuited end of the dipole causing a residual reflected return signal to appear at the antenna input. This return reflection is often referred to as "ringing" or may be referred to as "aperture clutter" since it clutters/obscures the aperture of the antenna.

Pulsed UWB transceivers are often employed in applications such as short-distance positioning, or length measurement etc. where a pulsed e/m signal is transmitted from the transceiver and its reflection subsequently received after a very brief time period.

Such applications require that the entire e/m signal pulse has exited the antenna of the transceiver before any reflection of that signal is expected to be received. This aims to ensure that the transmitted signal does not interfere with its received reflections and thereby obscure the positioning/measurement process.

However, ringing/aperture clutter results in just such obscurement and is highly undesirable.

DESCRIPTION OF PRIOR ART

Prior art pulsed UWB transceiver systems have attempted to overcome this problem by adding e/m signal absorbing material to the ends of the dipole antennas thereof or by loading the antennas with a distributed series of resistors along their length in an attempt to dampen or attenuate the standing waves therein which cause aperture clutter. However, such solutions are generally of little effect or most likely result in undesirably excessive attenuation of received/transmitted signal energy.

Furthermore, short-range positioning antennas etc. are most desirably small in physical size so as to be not only portable but also useable at close quarters and in confined spaces. This requires the antenna to be as small as possible. However, reducing the size of an antenna has, in the prior art, typically resulted in a corresponding reduction of bandwidth. This is undesirable.

The present invention aims to overcome at least some of the aforementioned deficiencies in the prior art. The proposed invention, in any of its aspects, provides an antenna for use particularly, though not exclusively, at microwave e/m signal frequencies.

SUMMARY OF THE INVENTION

The present invention proposes, in one of its aspects, an antenna having a tapered radiating element possessing a slow-wave structure along a tapered radiating edge thereof. The tapered radiating element supports wide bandwidths while the slow-wave structures along radiating edges extends the physical length of the radiating edge in question without increasing the size of the radiating element. This increase in radiating edge length supports an increase in antenna bandwidth without increasing antenna size, or permits one to reduce antenna size without reducing (or without significantly reducing) the bandwidth of the antenna.

The "slow-wave" structure may be any non-linear and meandering slant edge which provides a meandering radiating edge to the radiating element, and therefore slows down the progress of a signal wave travelling along the slant edge by constraining the signal wave to progress along the longer meandering slant edge rather than to progress directly along a shorter linear slant edge. Non-linear/meandering edges include, for example; any corrugated or serrated formation of or in the slant edge; a jagged slant edge; a castellated/crenulated slant edge; a wavy/oscillating slant edge or the like. Most preferably, the meanders of the slant edge (e.g. serrations/corrugations/castellations/crenulations/waves/oscillations or jags) are shaped such that the Q-factor of the antenna is minimised thereby reducing aperture clutter by reducing the relative magnitude of a signal reaching the terminal (open-circuit) end of the slant edge where signal reflection tends to occur—this being the source of aperture clutter. The Q-factor of the antenna is proportional to the ratio of: the electromagnetic energy stored in the antenna due to the signal propagating within the antenna; and, the rate of loss of e/m energy from the antenna due to the signal propagating along the slant edge:

$$\text{“}Q\text{-factor”} \propto \frac{\text{stored energy}}{\text{rate of energy loss}}$$

Thus, the relative magnitude of a signal reaching the terminal outer end of the slant edge (i.e. relative to the magnitude of that signal at the input/beginning of the slant edge) is sensitively dependent upon the rate of loss of energy from the signal during propagation along the slant edge. By suitably shaping the meanders of the slow-wave structure, the present invention may enhance the rate of radiative energy loss of the propagating signal as it progresses along the slant edge. The result is a reduced signal magnitude at the terminal end of the slant edge and, therefore, a reduced reflection signal back along the slant edge (i.e. reduced aperture-clutter). This technique of reducing aperture clutter avoids the use of radiation attenuating materials (RAM) in reducing reflected signal magnitudes by simply causing signals to radiate from the slant edge more readily or rapidly and does not merely "damp" the signals as RAM would.

Accordingly, the slow-wave structure may comprise a series of saw-tooth serrations which may, for example, be formed by a series of straight edged tapering (e.g. triangular) notches which each extend into the radiating element at the slant edge thereby collectively rendering the slant edge into a jagged edge. However, other notch shapes could be employed, such as square notches or curved notches or the like. The notches may be contiguous such that the edge of one notch and the edge of a neighbouring notch meet at a convergence thereby collectively forming a serration point or end. Such contiguity helps increase the length of the slow-wave structure, particularly when the notch edges are straight, and so increases the bandwidth of the antenna.

In a first of its aspects, the present invention may provide an antenna comprising a radiating element having (e.g. at one end) a signal feed-point and two opposed slant edges which diverge with increasing distance from the antenna feed-point such that the radiating element tapers outwardly therefrom, wherein a slow-wave structure (e.g. a series of serrations) is formed in a slant edge so as to extend along the slant edge thereby to form a slow-wave structure for a signal propagating along the slant edge.

The signal Θ(x,t) propagating along a slant edge (e.g. dimension "x") at time "t" may be represented by the following equation:

$$\Psi(x,t)=A\ \exp(-j\Phi(x,t))$$

where M(x,t) is the phase of the wave representing the signal, and:

$$\Phi(x,t)=\beta x-\omega t$$

where ? is the angular frequency of the signal and ∃ is the propagation factor which, for a given signal frequency ? is related to the phase velocity $v_{ph}$ of the signal by the relation:

$$V_{ph}=T/\exists,\ \text{thus},\ \Phi(x,t)=\omega(x/v_{ph}-t).$$

A slow-wave structure is formed in a slant edge by shaping the slant edge in such a way that, in response to changes in signal frequency, the rate ($\partial\Phi/\partial\omega$) of the resulting change in the phase of the wave at a given point along its propagation path (i.e. the slant edge) is reduced.

This signal phase manipulation may be applied to the serrated/corrugated slant edge(s) of the present invention by shaping the corrugation/serrations of the slant edge to be either constant in size/scale, or to increase in size/scale with increasing distances (i.e. dimension "x") along the slant edge. For example, increasing distance "x" could be measured relative to the signal feed-point. A direct consequence of such signal phase manipulation has been found to be that the reactance of the radiating element changes much less in response to changes in signal frequency than would be the case where the slow-wave structure not shaped to implement the aforementioned signal phase manipulation. It has also been found that such a reduction in reactance changes is more significant when serrations increase in size/scale with increases in distance along the slant edge, especially when log-periodically scaled as discussed below. Thus, over a wide bandwidth of signal frequencies the radiating element may present substantially the same or at least similar reactance to signals with the consequence that where the antenna has been impedance-matched at a given signal frequency it will also tend to be impedance-matched (or nearly so) at many other signal frequencies within the bandwidth of the antenna. This near frequency-independence of reactance avoids or greatly reduces the degree of impedance mismatch in the antenna and so avoids or reduces the occurrence of the signal reflections which are caused by such mismatches and which are a source of aperture clutter. Hence, aperture clutter may be indirectly reduced by use of the aforesaid signal phase manipulation along the serrated slant edge of the radiating element of the antenna in the present invention. Furthermore, the near frequency-independence enables the overall antenna structure to be relatively small yet support a relatively large impedance matching bandwidth in spite of its small size.

Serrations in said series of serrations are preferably shaped to maximise or increase the rate of radiative loss of energy from a signal propagating along the slant edge. Preferably, the slow-wave structure is a series of serrations which may form a series of contiguous notches which extend into the radiating element from the slant edge. Serrations in the series may be shaped to terminate at the convergence of two tapering serration edges forming a single serration tip.

It is most preferable that successive serrations/corrugations are shaped and/or arranged within the series such that each serration/corrugation of the series electromagnetically couples as little as possible to neighbouring serrations/corrugations of the series in response to a signal propagating along the slant edge. Minimising such coupling enables each notch/serration to perform its function almost independently (as far as possible) of the function of the notches/serrations neighbouring it.

This de-coupling, or minimal coupling, is preferably maintained or approached by shaping each serration to terminate in a serration tip formed by the convergence of two serration edges at an angle of between about 75° to about 105°. It has been found that such a tip angle reduces inter-serration e/m coupling without significantly reducing the other benefits of the invention (e.g. small size, low Q-factor, broad bandwidth etc). This is particularly so when serration edges are substantially straight.

Preferably, the series of serrations defines (or is defined by) a series of notches each of which is defined by neighbouring edges of successive serrations which extend into the radiating element from a slant edge.

At high signal frequencies, such as microwave frequencies, signals are known to preferentially propagate along the outer edges of an antenna's radiating elements. Thus, by locating the series of serrations along the slant edges of the radiating element, the present invention aims to ensure that the majority of the signal within the antenna passes along the serrations and through the series of notches formed by the serrations and thereby maximally experiences the structure responsible for enhanced radiative signal power loss and responsible for increased signal bandwidth. This series of serrations and notches not only reduces aperture clutter but may also reduce the size of the antenna radiating element required to achieve a given signal operating bandwidth. This size reduction may be achieved by providing at a selected property of any given notch of the series is determined according to the corresponding property of the proceeding notch in a series so as to provide a notch series which is log-periodically distributed in respect of the selected notch property. Thus, the ratio of: the magnitude of the selected property in respect of a given notch; and, the magnitude of the selected property in respect of the notch proceeding the given notch, is a fixed scaling factor shared by all such notch pairs in the series.

For example, the selected property may be the magnitude of a dimension(s) of, or associated with, a given notch of the series which is arranged to differ from the magnitude of the corresponding dimension(s) of the proceeding notch of the series according to a predetermined scaling factor thereby to form a log-periodic distribution in respect of the magnitude of the dimension(s) in question along the series. The dimension(s) may be one or more of: the position of a notch along the slant edge as measured from the feed-point; the physical depth of a notch; the width of a notch at the slant edge. Other notch properties may be log-periodically distributed in this way.

Serrations in said series of serrations are preferably shaped such that corresponding dimensions of successive serrations increase log-periodically whereby the ratio of said corresponding dimensions in respect of (i.e. as between) successive such neighbouring serrations has a constant predetermined ratio value. Thus, since notch dimensions are defined by the dimension of neighbouring serrations, one may achieve a log-periodic scaling of notch dimensions by a suitable log-periodic scaling of serration dimensions.

For example, the length of an edge of any given serration of said series of serrations may exceed the length of the corresponding edge of the preceding serration of the series such that the ratio of said lengths in respect of successive serrations has a value substantially equal to said constant predetermined ratio value.

It is well known in the art that if the dimensions of a log-periodic antenna are scaled by a given proportion (e.g. doubled), and at the same time the wave length of signals in the antenna is scaled by the same proportion, the performance of the antenna will not substantially change. This property is known as "frequency independence" and arises because the property of the log-periodic antenna which gives it its log-periodicity is also invariant to changes of scale. Without such scaling invariants within the antenna radiating structure, it is difficult to achieve in a non-log-periodic antenna a performance (e.g. bandwidth) comparable to that of a log-periodic antenna structure without increasing the size of the non-log-periodic antenna radiating structure.

Preferably, the distance between the location of the feed-point and the location of successive serrations of the series increases log-periodically whereby the ratio of the said distance in respect of successive serrations has a constant predetermined ratio value.

Thus, preferably, the serrations of the series of serrations are arranged in a suitable fashion so as to provide a so-called "frequency independent" antenna radiating element (i.e. able to radiate effectively at any frequency within a broad band of frequencies) as discussed above. This may be achieved in the present invention by spacing the notches (which define the serrations) in the series of notches so as to form a log-periodic positioning of notches along the slant edge.

Each notch of the series of notches preferably extends into the radiating element from a respective location along the slant edge which location is spaced from the antenna feed-point by a distance chosen such that the ratio of such distances as between neighbouring notches has a constant predetermined ratio value. The distance by which a given notch or serration is spaced from the feed-point is preferably a distance measured along the slant edge of the antenna's radiating element but excluding the lengths of other notches/serrations of the series intermediate the feed-point and the given notch/serration (i.e. the distance being measured along the slant edge as if the/any intermediate notches/serrations, which have edges, were absent.

The location of a given notch/serration may be measured from the near most edge of the notch/serration at the slant edge, or from the far most edge thereof or from the midpoint between opposing edges of the notch/serration at the slant edge.

However one chooses to measure the aforesaid distance $r_i$; in respect of each slot/serration (i) in the series, the log-periodic nature of the series is such that: $r_{i+1}/r_i$=constant, as between a given notch/serration "i" at the successive neighbouring notch/serration "i+1" where the ratio value is a constant greater than 1 (one).

The widths of the notches/serrations of the series may be chosen to scale log-periodically along the series. That is to say, the width of any given notch/serration of the series (as measured between opposing points on opposing edges of a given notch/serration) may be chosen to exceed the width of the preceding notch/serration of the series (similarly measured) such that the ratio of widths as between those neighbouring notches/serrations has a value substantially equal to the aforesaid constant predetermined ratio value.

Each one of the two opposed slant edges of the radiating element preferably has a respective said series of serrations formed therein.

The opposed series of serrations may be arranged symmetrically such that one is the mirror image of the other along a line extending through the radiating element from the feed-point and between the two slant edges.

Divergent tapering of the radiating element from the antenna feed-point provides an antenna suitable for broadband signal transmission and reception as associated with pulsed UWB applications. The radiating element may be shaped to taper outwardly from an apex or point at the antenna feed-point. The radiating element may be triangular in shape (generally speaking), or may be in a shape of a segment of a circle with an arcuate distal peripheral edge bridging the terminal outermost ends of the two slant edges. However, this distal peripheral edge may be other than arcuate, and the radiating element may have an antenna feed-point at other than an apex or point, and the tapering edges may taper from other than a convergent apex/point i.e. the edges may never "meet".

The invention in a second of its aspects, may provide an antenna having a tapered radiating element one end of which is an antenna feed-point, the radiating element having two opposed slant edges which diverge with increasing distance from the slant edge such that the radiating element tapers outwardly thereform, wherein the radiating element has a distal peripheral edge bridging the terminal outermost ends of the two slant edges thereof which recedes towards the feed-point at the mid-region thereof so as to shape the radiating element into two symmetrical lobes which diverge with increasing distance from the feed-point.

The invention, in its second aspect, may also incorporate the features of the invention in its first aspect including none, some or all of the aforementioned variants, preferable features and alternative features of the first aspect of the invention. In its second aspect the radiating element may be combined with a ground plane conductor to form a monopole antenna.

At low signal frequencies, the radiating element of the invention in its second aspect behaves as a simple monopole (when combined with a ground plane). As the signal frequency rises, the symmetrical lobes of the radiating element tend to bifurcate the signal into two slant polarisations defined by the divergent orientations of the lobes. This has the beneficial effect of maintaining a wide elevation beam width of radiated signals and also introduces a radiated electrical field component along its geometrical axis of symmetry (i.e. the axis about which the divergent lobes have mirror symmetry). This produces a wide elevation beam width of radiated signals and a shallow radiation null along the direction of the geometrical symmetry axis of the radiating element, which one would not expect from a conventional monopole antenna (one would expect a complete, zero-signal, null along the axis of symmetry).

Preferably, the mid-region of the distal peripheral edge partially recedes towards the feed-point to form a V-shaped notch which extends into the radiating element with an apex angle less than about 90 degrees. However, other notch shapes are permissible which result in divergent symmetrical lobe shapes in the radiating element.

Constraining the apex angle of a v-shaped notch to less than about 90° has been found to cause the peripheral notch to preferentially suppress the occurrence of transverse signal modes which would otherwise tend to propagate along the distal peripheral edge of the radiating element and interfere with the operation and performance of the antenna undesirably.

The present invention may provide an antenna according to any of the first and second aspects of the invention having said radiating element and a ground plane conductor relative to which the radiating element extends substantially perpendicularly, or across which the face of the radiating element extends (e.g. parallel thereto or otherwise), thereby to form a monopole antenna. In the former case the monopole antenna so produced is preferably an omnidirectional antenna operable to radiate in all directions in the azimuthal plane, whereas in the latter case the resultant antenna is preferably unidirectional being more limited in its azimuthal range.

The radiating element is most preferably planar, in which case the radiating element may be arranged so that its plane is substantially perpendicular to that of the ground-plane from which (or relative to which) it extends, or may be plane parallel therewith.

In another aspect of the invention there may be provided a monopole antenna having a radiating element and a ground plane conductor structure defining a non-planar ground plane surface being deformed such that parts of the surface are displaced, relative to other parts thereof, towards the radiating element.

For example in a third of its aspects, the present invention may provide a monopole having a radiating element and a ground plane conductor defining a ground plane surface which includes: a substantially planar first surface portion arranged nearmost the radiating element to face the radiating element; and, a second planar surface portion extending away from the first surface portion so as to be non-coplanar therewith and so as to face generally towards the radiating element. In facing generally towards the radiating element, a normal to (and extending from) the second surface converges with a corresponding normal to the first surface portion. For example, the ground plane may be shaped to include two separate planar parts joined (e.g. integrally, at a fold in the ground plane structure) whereby the radiating element is arranged to extend substantially perpendicularly from one of the two planar parts of the (e.g. folded) ground plane and a face (e.g. plane) of the radiating element is arranged to extend across the other of the two planar parts thereof. The invention in its third aspect may also include the features of the invention in its first and/or its second aspects including some, none or all of the variants and preferably features of the first and second aspects as identified above.

By shaping the ground plane conductor in this way (e.g. folding or arranging a fold-like structure), the part of the ground plane across which a face (e.g. plane) of the radiating element extends acts to reflect radiation emanating towards it from the radiating element. Consequently the monopole antenna formed by the radiating element together with the ground plane conductor so shaped acts as a directional antenna having a directionality determined by the reflecting portion of the ground plane.

The face or plane of the radiating element may be substantially parallel to the plane of the other of the two planar parts of the (e.g. folded) ground plane. In this orientation, signals emanating from the radiating element towards the parallel ground plane part will be reflected directly back towards the formed by the latter.

Alternatively, the face or plane of the radiating element may be other than parallel to the plane of the other of the two planar parts of the (e.g. folded) ground plane, such that the separation between the face or plane of radiating element and the part of the ground plane across which it extends varies (e.g. increases) with increasing distance (e.g. along the radiating element) from the feed-point. This has the added advantage of greatly reducing signal cancellations which occur when the separation between the radiating element and the part of the ground plane across which it extends, is equal to one half of the wavelength of a radiated signal. In such cases the signal radiated by the antenna is slightly reduced in magnitude due to such cancellations since the cancelled part of the reflected signal no longer contributes to the whole signal. By varying the separation one ensures that such resonance occurs only at a very small region of the antenna where the half-wavelength separation only occurs regionally.

Preferably, the first part of the ground plane across which a face of the radiating element extends, and the second part relative to which it extends perpendicularly, meet each other at an angle of from 90 degrees to 120 degrees thereby resulting in a separation between the first part of the ground plane and the radiating element which is either constant (90° angle) or increases with increasing distance from the feed point (angles between 90° and 120°).

In a further aspect the present invention may provide a monopole antenna having a radiating element and a ground plane conductor structure defining a non-planar ground plane surface being deformed such that peripheral parts of the surface are displaced, relative to other parts thereof, away from the radiating element.

For example, in the fourth of its aspects, the present invention may provide a monopole antenna having a radiating element and ground plane conductor defining a ground plane surface which includes: a substantially planar central surface portion arranged nearmost the radiating element to face the radiating element; and, an outer surface portion which contains a peripheral part of the ground plane surface, wherein the outer surface portion extends away from the central surface portion so as to be non-coplanar therewith and to face generally away from the radiating element.

In facing generally away from the radiating element, the normal to (and extending from) any point on the outer surface portion does not intersect the radiating element, nor is it parallel to any corresponding normal to the central surface portion, but rather, it diverges therefrom.

This arrangement presents a generally convex ground plane conductor surface for the radiating element, the surface comprising the planar central surface portion presented towards the radiating element and the outer surface portion not presented towards the radiating element. The outer surface portion may also be planar or may be curved or may have curved regions contiguous with planar regions. For example, the outer surface portion may comprise a planar region extending away from the central surface portion and a contiguous curved region extending away from the planar region wherein the curved region contains a peripheral part of the ground plane surface. In this way, the outer surface portion may contain a curved region in which the peripheral surface in question is displaced to face away from the radiating element to an even greater extent than that to which the planar region of the outer surface portion is so displaced. The radiating element preferably extends/stands substantially perpendicularly relative to the central surface portion of the ground plane surface.

The non-coplanar surface portions, and the non-coplanar surface regions within the outer surface portion may be defined by, or joined at, e.g. by a fold/bend or other shaping in the ground-plane structure. This aspect of the invention may also include the features of the invention in any one of its first, second and third aspects including some, none, or all of the variants and preferably features thereof as discussed above in relation to those other aspects.

The electric field of the monopole antenna, in use, emanates from the radiating element and terminates at the upper surface of the ground plane conductor. However, when terminating at the peripheral edge of a ground plane conductor, such fields often induce stray currents which, in turn, may induce stray currents in the underside of the periphery of the ground plane. Consequently, stray electric fields which emanate from the stray currents at the ground plane underside may interfere with the antenna signal feed input at the underside of the ground plane. This is undesirable.

Such effects of stray electric fields may be reduced by increasing the size of the ground plane and thereby reducing the magnitude of the electric fields reaching its periphery. As a result, the stray induced currents and, thus, the stray electric fields they generate are accordingly reduced. However, to minimise antenna size yet produce the same effect, the invention, in its fourth aspect, proposes displacing the ground plane's peripheral edge (or parts of it) away from the plane of the ground plane and away from the radiating element. This geometry capitalises on the fact that the electric field lines terminating at the ground plane's upper surface must do so at an angle of 90° thereto. Hence, by displacing the upper surface of the peripheral parts of the ground plane away from the source of the electric field lines (i.e. the radiating element) one forces such field lines to loop outwardly in space in order that the field line may terminate at the displaced ground plane upper surface at an angle of 90° thereto.

This deforming effect not only causes the relevant electric field lines to traverse a greater distance in space thereby reducing their magnitude at their termination point (and hence the size of stray currents they induce), but also has the effect of increasing the proportion of electric field lines terminating at the upper surface of the undisplaced portion of the ground plane, with a consequent reduction in the proportion of field lines terminating at the upper surface of the displaced ground plane peripheral part, and a consequent reduction in the magnitude of stray currents inducible thereby. This ground plane geometry is equivalent to increasing the planar extent of a fully planar ground plane but obviates the need to do this thereby saving space.

Some or all of the periphery of the ground plane may possess radiation absorbing material (RAM) underneath the peripheral parts of the ground plane surface. Where the outer surface portion includes a non-planar region containing a peripheral part of the ground plane surface as discussed above, the non-planar region may be curved or folded through any angle up to and exceeding 180 degrees relative to the planar portion/region of the ground plane from which it extends (e.g. defining a semicircular surface). In such a case the ground plane structure may possess radiation absorbing material (RAM) located between those parts of the non-planar region which face in opposite directions, and most preferably the RAM extends across sufficient area of the underside of the ground plane conductor structure (i.e. the side opposite to, or reverse to, the aforesaid ground plane surface) that said peripheral edge portions of the non-planar region (or its underside) are not exposed to the underside of the outer surface portion of the ground plane surface at least.

Preferably, the outer surface portion extends away from the central surface portion at an angle of no more than 90° relative to the plane of the central surface portion (i.e. an angular displacement of the outer surface portion, relative to the central portion, not exceeding 90 degrees).

Increasing this angle beyond 90° reduces antenna gain since it results in displaced parts of the ground plane conductor at least partly extending across other parts of the ground plane conductor resulting in dipole-like behaviour which is undesirable in a monopole antenna.

The term "ground plane" herein refers to the functional aspect of a ground plane structure of a monopole antenna and includes planar structures as well as non-planar structures which perform this function.

The present invention may also provide a portable impulse transceiver apparatus, or an ultra wide-band (UWB) communications apparatus, comprising an antenna according to the invention in any of its aspects.

It is to be understood that the invention, in any of the aforementioned aspects, and variants thereof, represents the result of the implementation of methods of producing an antenna, which methods are also encompassed by the present invention.

Accordingly, in a fifth of its aspects, the present invention may provide a method of producing an antenna comprising, providing a radiating element, providing the radiating element with two opposed slant edges which diverge with increasing distance from an antenna signal feed-point such that the radiating element tapers outwardly therefrom, forming a slow-wave structure (e.g. series of serrations) in a slant edge so as to extend along the slant edge thereby to form a slow-wave structure for a signal propagating along the slant edge.

The series of serrations preferably forms a series of contiguous notches extending into the radiating element from the slant edge.

Where the slow-wave structure is a series of serrations, the method of producing an antenna may include shaping one or more (preferably all) serrations in said series of serrations so as to increase the rate of radiative loss of energy from a signal propagating along the slant edge. Serrations may be shaped to terminate at a convergence of two tapering serration edges forming a single serration tip. For example, the method may include shaping serrations in said series of serrations with a common shape such that corresponding dimensions of successive serrations increase log-periodically whereby the ratio of said corresponding dimensions as between successive such neighbouring serrations has a constant predetermined ratio value. The method may include shaping said serrations to terminate at a serration tip formed by the convergence of two serration edges at an angle of between about 75 degrees and about 105 degrees (e.g. about 90 degrees).

As a specific example of such log-periodic shaping, the method may include forming said serrations such that the length of an edge of any given serration of said series of serrations exceeds the length of the corresponding edge of the preceding serration of the series such that the ratio of said lengths in respect of successive serrations has a value substantially equal to said constant predetermined ratio value. Log-periodic shaping of other serration dimensions are possible of course.

Indeed, the arrangement of serrations along the slant edge may be made log-periodic whereby the method would then include shaping said serrations such that the distance between the location of the feed-point and the location of successive serrations of the series increases log-periodically whereby the ratio of the said distance in respect of successive serrations has a constant predetermined ratio value.

Preferably, the method of producing an antenna includes forming in each one of the two opposed slant edges of the radiating element a respective said series of serrations formed therein.

In a sixth aspect of the invention, the present invention may provide a method of producing an antenna including providing a radiating element, providing the radiating element with the opposed slant edges which diverge with increasing distance from an antenna feed-point such that the radiating element tapers outwardly therefrom providing in the radiating element a distal peripheral edge bridging the terminal outermost ends of the two slant edges thereof, and shaping the distal peripheral edge so as to partially recede towards the feed-point at the mid-region thereof so as to shape the radiating element into two symmetrical lobes which diverge with increasing distance from the feed-point. The invention in its sixth aspect may also include the features of the fifth aspect of the invention, including some, none or all of the variants or preferable features of that fifth aspect.

The method according to the invention in its sixth aspect preferably includes shaping the mid-region of the distal peripheral edge such that it partially recedes towards the feed-point to form a V-shaped notch which extends into the radiating element with an apex angle less than about 90 degrees.

The method of producing an antenna according to either the fifth or sixth of its aspects preferably includes providing a ground plane conductor from and arranging the radiating element to extend substantially perpendicularly relative to the ground plane, or arranging the face or plane of the radiating element to extend across the ground plane conductor, thereby to form a monopole antenna.

In yet another aspect of the invention there may be provided a method of producing an antenna including providing a radiating element and a ground plane conductor structure defining a non-planar ground plane surface deformed such that parts of the surface are displaced, relative to other parts thereof, towards the radiating element.

For example, in a seventh of its aspects the present invention may provide a method of producing an antenna including providing a radiating element and a ground plane conductor and shaping the ground plane to define a ground plane surface which includes a substantially planar first surface portion arranged nearmost the radiating element to face the radiating element; and, a second planar surface portion extending away from the first surface portion so as to be none-coplanar therewith and so as to face generally towards the radiating element.

For example, the method may include shaping the ground plane to include two separate planar parts joined (e.g. integrally, at a fold in the ground plane structure) arranging the radiating element to extend substantially perpendicularly relative to one of the two planar parts of the (e.g. folded) ground plane and arranging a face (e.g. plane) of the radiating element to extend across the other of the two planar parts thereof. This seventh aspect of the present invention may also include the features of any one of the fifth and sixth aspects of the invention, including some, none or all of the aforementioned variants and preferably features thereof.

In the seventh aspect of the invention, the method may include shaping the ground plane such that the face or plane (if planar) of the radiating element is substantially parallel to the plane of the other of the two planar parts of the (e.g. folded) ground plane. Alternatively, the method may include shaping the ground plane such that the face or plane of the radiating element is other than parallel to the plane of the other of the two planar parts of the (e.g. folded) ground plane, such that the separation between the radiating element and the part of the ground plane across which its face extends varies (e.g. increases) with increasing distance from the feed-point.

In a further aspect the present invention may provide a method of producing a monopole antenna including providing a radiating element and a ground plane conductor structure defining a non-planar ground plane surface being deformed such that peripheral parts of the surface are displaced relative to other parts thereof, away from the radiating element. For example, in an eighth of its aspects, the present invention may provide a method of producing an antenna including, providing a radiating element and a ground plane conductor defining a ground plane surface which includes: a substantially planar central surface portion arranged nearmost the radiating element the face of the radiating element; and, an outer surface portion which contains a peripheral part of the ground plane surface, wherein the outer surface portion extends away from the central surface portion so as to be non-coplanar therewith and to face generally away from the radiating element.

The eighth aspect of the invention may also include the features of any one of the fifth, sixth or seventh aspects of the invention, including some, none or all of the variants and preferably features thereof.

The method may also include forming the outer surface portion so as to extend away from the central surface portion at an angle of no more than 90° relative to the plane of the central surface portion (i.e. an angular displacement of the outer surface portion, relative to the central portion, not exceeding 90°).

BRIEF DESCRIPTION OF THE DRAWINGS

Non-limiting examples of the present invention shall now be described with reference to the accompanying drawings in which:

FIG. 1 illustrates the radiating element of a monopole antenna upstanding from a ground plane conductor;

FIG. 2*a* illustrates the radiating element of a monopole antenna together with a ground plane conductor, being plane-parallel therewith;

FIGS. 2*b* and 2*c* illustrate side views of the monopole antenna of FIG. 2*a;*

FIGS. 4*e* and 4*f* illustrates sides use of the monopole antenna which the ground plane is folded, or has a fold like structure;

In the FIGURES like elements have been given the same reference sign for consistency.

DETAILED DESCRIPTION OF PREFERRED EMBODIMENTS

Figure 3A:
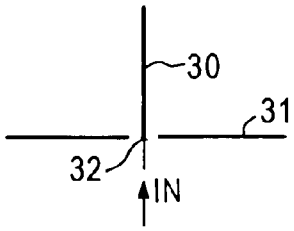
FIGS. 3*a*, 3*b*, 3*c*, 3*d* and 3*e* each illustrate side views of a monopole antenna, with a ground plane conductor either flat or folded in different configurations.

Referring to FIG. 1 there is illustrated a monopole antenna 1 comprising a planar radiating element 2 comprising a substantially flat sheet of conductive material generally shaped as a segment having two opposed slant edges 6, which diverge outwardly from an apex of the segment. The antenna radiating element 2 has a signal feed-point 5 at the apex of the segment.

The two opposed slant edges 6 diverge with increasing distance from the antenna feed-point 5 such that the radiating element 2 tapers outwardly from the feed-point. The radiating element possesses a distal peripheral edge (8, 9 and 10) which bridges the terminal outermost ends of the two opposed slant edges and forms the curved outermost periphery of the radiating element.

The radiating element has two identical series of serrations 7*b* each formed within a respective one of the two opposed slant edges. Each serration of a given series of serrations is formed by a pair of successive angular (tapering) notches 7*a* which extend into the planar sheet of the radiating element 2 from the respective slant edge 6. Each tapering notch has notch edges which converge to terminate within the sheet 2 of the radiating element at a right-angled apex 7*a*. Consequently, at the portion of the radiating element in between such pairs of tapering notches there is formed one serration of the series of serrations 7*b* in the respective slant edge 6.

Each such serration, and the series of serrations collectively, presents a slow-wave structure to a signal propagating along the slant edge.

Successive serrations of each series of serrations are shaped to increase in size relative to the preceding serrations in a log-period manner. Thus, the serrations in a given series have a common shape. In this example the common shape is a straight-edged serration with two tapering edges extending from the body of the radiating element at predetermined angles and converging at increasing distance from the body of the radiating element to a terminal right-angular serration tip or apex.

The converging edges of a given serration may differ in length as in the example in FIG. 1, or may be equal in length as in the alternative example shown in FIGS. 2*a*, 2*b* and 2*c*.

In either example, a successive serration in a given series of serrations possess two tapering edges which each extend from the body of the radiating element at the same predetermined angles as occurs in respect of the edges of the preceding serration of the series, and also converge at a right angular serration apex. The ratio of the lengths of the two tapering edges of any given serration is shared by all serrations in the same series since all serrations in a given series share the same general shape. However, due to log-periodic scaling, the lengths themselves increase by a predetermined scaling value such that the ratio of a serration edge length of a given serration and the corresponding edge length of the succeeding serration has a constant predetermining ratio value shared by all such neighbouring serrations.

Furthermore, each series of serrations 7*b* along a respective FIG. 1 is arrange such that the distance between the location of the feed-point 5 of the radiating element and the location of the serration increase log-periodically as one encounters successive serrations of a given series. The result is that the ratio of the aforesaid distance, as between two neighbouring (successive) serrations, is equal to a constant predetermined ratio value shared by all such neighbouring serrations. The location of the serration may be considered to be the location of the apex or the tip of the serration in question, for example.

The antenna 1 also includes a ground plane conductor 3 seen inside-view in FIG. 1 and perpendicular to the radiating element 2 which extends through an aperture within the centre of the ground plane to which the outer sheet 4 of a coaxial cable is connected. The inner core of the coaxial cable is connected to, and feeds, the antenna feed-point 5 of the antenna radiating element 2. The ground plane conductor 3 spans outwardly from the aperture in its centre in all directions perpendicular to the axis of symmetry of radiating element to form a flat conductor sheet which underlays all parts of the two slant edges 6 of the radiating element and beyond.

The distal peripheral edge (8, 9 and 10) of the radiating element bridging the terminal outermost ends of the two slant edges thereof is shaped to partially recede towards the feed-point 5 of the antenna at the mid-region of the outer peripheral edge. The result of this edge recession is the formation of a recess 8 being centred upon the axis of symmetry of the radiating element and being itself symmetrical in shape about that axis. Opposing edges of the recess are linearly shaped to converge inwardly in the direction of edge recession at equal angles (?/2) relative to the symmetry axis and to converge at a point within the face/plane of the radiating element some distance from the feed-point.

The recess thereby not only forms a v-shaped notch having an apex angle ?(?<90°) but also shapes the radiating element as a whole into two diverging lobes each being the mirror image of the other across the symmetry access.

This divergent lobe structure promotes bifurcation of signals within the radiating element along the divergent directions of the lobes. This has the beneficial effect of maintaining wide elevation beam width in radiated signals and induces a radiated electric field component along the geometrical symmetry axis of the radiating element (i.e. perpendicular to the ground plane) which removes any signal null in that direction and allows signal transmission/detection perpendicular to the ground plane.

FIGS. 2*a*, 2*b* and 2*c* show a plan view and two side views, respectively, of an alternative monopole antenna arrangement 11 according to the present invention. In this alternative, the plane of the radiating element 12 of the antenna is arranged to extend across the ground plane 13 such that the plane of the former is spaced from, but is parallel to, the plane of the latter. Otherwise the structure and functional features of the antenna arrangement of FIGS. 2*a*, 2*b* and 2*c* are substantially the same as the corresponding features illustrated in FIG. 1 and discussed above. For example, a given feature of the antenna illustrated in FIG. 1 assigned a particular reference number may be correspondingly identified in the antenna illustrated in FIGS. 2*a*, 2*b* or 2*c* using a reference number which differs from the reference number of the corresponding feature in FIG. 1 by a value of 10. Thus, for example, item 3 of FIG. 1 and item 13 of FIGS. 2*a*, 2*b* or 2*c* (i.e. 13=3+10) both correspond to the ground plane conductor of the respective antennas, while the items 6 of FIG. 1 and item 16 of FIGS. 2*a*–2*c* both correspond to equivalent slant edges.

With this in mind, and with the exception of the discussion of the orientation of the radiating element 2 relative to the ground plane conductor 3, the reader is referred to the above text describing the antenna of FIG. 1 for a discussion of the corresponding features of the antenna of FIGS. 2*a*–2*c*, reference numbers renumbered accordingly.

The side view of FIG. 2*b* is a view "edge-on" towards the edge A of the ground plane 13, being the same orientation or view as is used in FIG. 1. The side view of FIG. 2*c* is a view "edge-on" towards the edge B of the ground plane. As can be seen in these side views, the outer sheath of the coaxial cable 14 connecting with the ground plane 13 extends through the aperture in the ground plane where it connects to the ground plane, and extends beyond that aperture someway (about halfway) into a space between the ground plane and the feed-point 15 on the overlaying radiating element 12 thereby to provide an impedance matching section.

FIG. 3*a* illustrates a side view (edge-on) of a monopole antenna comprising a radiating element 30. The antenna radiating element 30 having a signal feed-point 32 positioned at the base of the radiating element and centred within an aperture arranged within the ground plane sheet 31 (seen edge-on in FIG. 3*a*) from which the radiating element 32 perpendicularly extends.

Electric fields emanating from the radiating element and terminating at the periphery of the ground plane upper surface may induce stray currents which, in turn, may induce currents and electric fields at the underside of the ground plane. Such induced electric fields are undesirable.

Figure 3B:
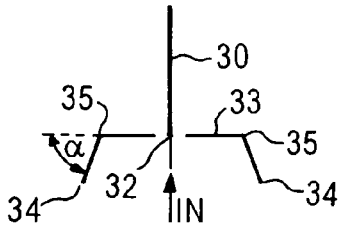
Figure 3C:
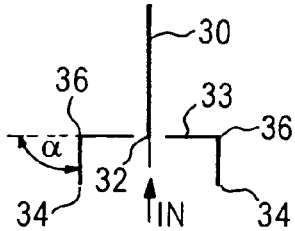

FIGS. 3*b* and 3*c* show different embodiments of an aspect of the present invention which aim to address this undesirable situation. In each of these differing embodiments, a part of the outer peripheral edge 34 of the ground plane 33 is folded (by differing angles) away from the radiating element. This displacement reduces the magnitude of the common mode current induced in the outer periphery of the ground plane. The fold (35 or 36) may be a direct fold integrally formed within the structure and material of the ground plane conductor 33. Alternatively, the fold may be formed at the join of two separate but electrically connected ground plane conductor portions. Of course, it is to be understood that the displacement of the peripheral edge portion 34 of the ground plane conductor away from the radiating element may be achieved by other than a simple fold (35 or 36) and may be achieved by curving the outer regions of the ground plane smoothly and continuously with increasing proximity to the outer peripheral edge portion thereby to suitably displace the edge portion from the radiating element without forming a sharp fold 36.

The angular displacement ∀ of the outer peripheral edge portion 34, as measured from the plane of the central parts of the ground plane, is chosen to reduce the magnitude of stray currents induced in the peripheral edge of the ground plane. It is most preferable that the maximum displacement angle ∀ is 90° as illustrated in the example of FIG. 3*c*.

It is to be understood that either some or all of the outer peripheral edge of the ground plane may be displaced away from the radiating element of the antenna in the manner described above.

Figure 3E:
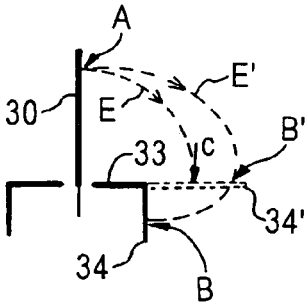

FIG. 3*e* schematically illustrates the effect of displacing the outer peripheral portion 34 of the ground plane upon the shape of the electric field lines (E) emanating from the radiating element 30 and terminating at the displaced upper surface 34 of the ground plane. In the absence of ground plane displacement, an electric field line E emanating from a point A on the radiating element 30 may terminate at point C of a completely planar ground plane upper surface (33 and 34') the electric field line E impinges upon the upper ground plane surface perpendicularly thereto. Subsequent displacement of the outer surface portion 34 of the ground plane causes the electric field line in question to bulge outwardly so as to enable the field line to terminate at point B of the displaced peripheral surface portion 34 of the ground plane. As is indicated in FIG. 3*e*, the deformed electric field line E' intercepts the plane containing the undisplaced central portion of the ground plane surface 33 adjacent the radiating element 30 at a point B' displaced outwardly from the point C at which the undeformed electric field line E previously terminated prior to displacement of the outer peripheral portion 34 of the ground plane surface. Consequently, not only is the length of the deformed electric field line E' greater than that of the undeformed electric field line E, and therefore of smaller magnitude at its point of termination (B), but also any stray electrical currents induced by that field at the peripheral portions of the ground plane surface will be correspondingly reduced.

Figure 3D:
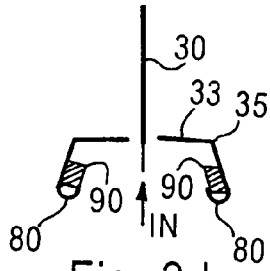

FIG. 3*d* schematically illustrates a monopole antenna the outer surface portions of which not only contain planar regions extending from a fold 35 in the ground plane, but also contain peripheral curved surface regions 80 extending from the aforementioned planar regions. The curved peripheral surface regions 80 curve through an angular displacement up to or exceeding 180 degrees with radiation absorbing material (RAM) 90 located between the terminal edge of the ground plane conductor and the opposing underside of the displaced portion of the ground plane conductor. This extreme deformation not only greatly reduces the magnitude of electric field lines emanating from the radiating element 30 and terminating at the extreme periphery of the ground plane conductor surface 80, thereby reducing the magnitude of electrical fields induced by stray currents thereat, but also significantly damps any such induced electrical fields.

Figure 4A:
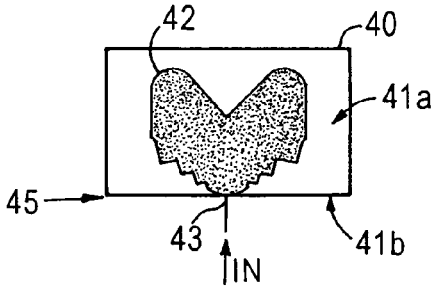
FIG. 4*a* illustrates a monopole antenna with a ground plane folded such that the radiating element extends perpendicularly from one part thereof, and the face of the antenna element extends across another part of the ground plane.

Referring to FIG. 4*a* there is illustrated a monopole antenna comprising a radiating element 42 fed with signals at a feed-point 43 thereof and being arranged in conjunction with a ground plane conductor 40 to provide a monopole antenna. The ground plane conductor 40 is shaped to include two separate planar parts, 41*a* and 41*b*, joined at a fold 45 in the ground plane structure such that one of the planar parts 41*b* of the ground plane structure extends perpendicularly from the other of the two planar parts 41*a* thereof. The view of the antenna of FIG. 4*a* is a view taken "face-on" such that the face of the radiating element 42 is in full view. Conversely, only the edge of the planar part 41*b* of the ground plane conductor from which the radiating element perpendicularly extends can be seen in the view provided by FIG. 4*a*. However, due to the folding of the other part 41*a* of the two planar parts of the ground plane towards the radiating element 42, the view of FIG. 4*a* provides a complete "face-on" view of that upwardly folding ground plane part.

Figure 4B:
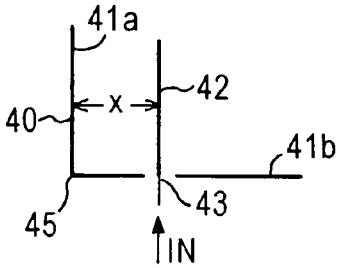
FIG. 4*b* shows a side view of the antenna of FIG. 4*a;*

FIG. 4*b* provides a side view (with the antenna of FIG. 4*a* rotated through 90° about the axis of symmetry of the radiating element 42) in which the fold 45 in the structure of the ground plane conductor 40 can be seen. The face of the radiating element 42 is consequently arranged to extend across the face of the upwardly folded part 41*a* of the ground plane conductor such that the plane of the radiating element and the plane of the upwardly folded ground plane conductor portion are parallel such that the separation "x" between any point on the face of the antenna structure 42 and any opposing point on the face of the upwardly extended ground plane conductor portion is constant in value.

The fold 45 formed in the structure of the ground plane conductor may be a direct and integrally formed fold in the material of the ground plane. Alternatively, the fold may be formed at the join or interconnection between two otherwise separate ground plane conductor portions (i.e. not integrally formed).

Figure 4C:
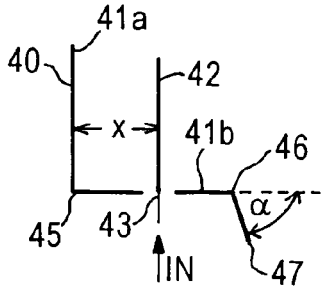
FIGS. 4*c*, 4*d* and 4*e* show side views of a monopole antenna having a fold or a fold like structure in the ground plane thereof which displaces a portion of the peripheral outer edge of the ground plane from the radiating element of the antenna.
Figure 4D:
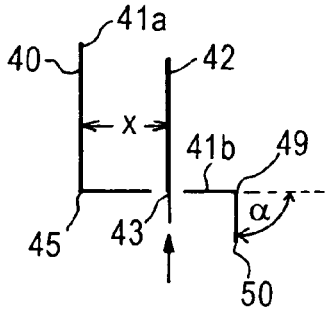

FIGS. 4*c* and 4*d* illustrate further developments of the embodiment illustrated in FIGS. 4*a* and 4*b*, and like features have been assigned like reference numerals. As can be seen in the embodiments of FIGS. 4*c* and 4*d*, in addition to folding one portion 41*a* of the ground plane conductor 40 towards the radiating element 42, the ground plane conductor structure possesses an additional fold, 46 or 49, which displaces an outer peripheral edge portion of the ground plane 47 or 50, away from the radiating element 42 through a displacement angle α of up to 90°. The form, structure and purpose of this displacement of the outer peripheral edge portions, 47 or 50, is as described with regard to the corresponding edge displacements illustrated in FIG. 3*b*, 3*c* and FIG. 3*d*.

The fold, 46 or 49, about which the outer peripheral edge portion, 47 or 50 respectively, is displaced is a linear fold running parallel to the linear edge of the displaced outer peripheral edge portion in question. Similarly, the fold 45 about which the upwardly folding planar part 41*a* of the ground plane structure is upwardly displaced is also a linear fold and runs parallel to the fold, 46 or 49, in the other of the two planar parts, 41*b*, about which the aforementioned outer peripheral edge, 47 or 50, is displaced.

Figure 4E:
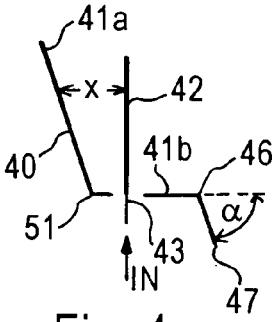
Figure 4F:
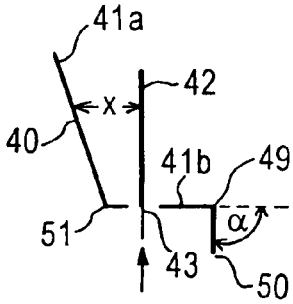

FIGS. 4*e* and 4*f* illustrate a side view of a monopole antenna comprising a radiating element 42 and a ground plane conductor structure 40 through which the radiating element 42 extends and is fed at a feed-point 43. As in the monopole antenna structures illustrated in FIG. 4*a*–4*d*, the ground plane conductor structure 40 is shaped to include two separate planar parts joined at a fold 51 in the ground plane structure 40. The radiating element 42 of the monopole antenna is arranged to extend substantially perpendicularly from one part 41*b* of the two planar parts of the folded ground plane structure and the face of the radiating element is arranged to extend across the other part 41*a* of the two planar parts of the ground plane. However, the face of the radiating element 42 is other than parallel to the plane of the other part 41*a* of the two planar parts of the folded ground plane structure 40, such that the separation "x" between the radiating element 42 and the part 41*a* of the ground plane across which the face of the radiating element extends increases with increasing distance from the feed-point 43. This divergence in the separation of opposing faces of the ground plane conductor structure and the radiating element significantly reduces the effect of cancellations as between radiated signals emanating from the radiating element 42 towards the opposing face of the upwardly displaced planar part 41*a* of the ground plane, and signals reflected from the latter propagating towards the former.

Figure 5A:
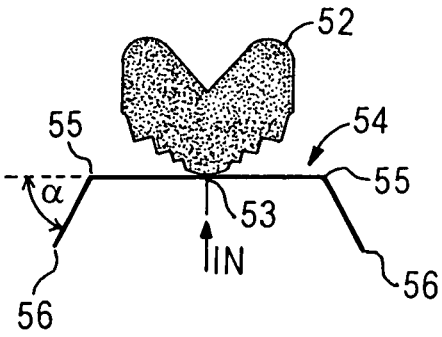
FIGS. 5*a* and 5*b* illustrate monopole antennas having a ground plane conductor a peripheral edge portion of which is folded away from the radiating element of the antenna.
Figure 5B:
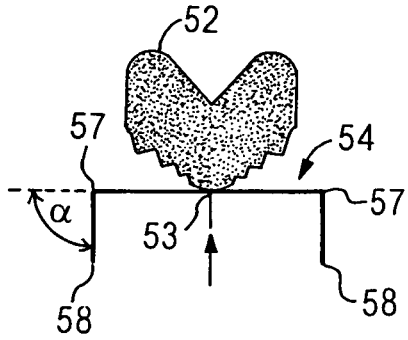

FIGS. 5*a* and 5*b* each illustrates variants of the monopole antennas illustrated in FIG. 3*b* and FIG. 3*c* respectively. According to these variants, the monopole antenna, which comprises a planar radiating element 52 with serrated slant edges which taper outwardly from a feed-point 53 of the antenna, possesses a ground plane structure 54 possessing displaced outer peripheral edge portions, 56 or 58, which extend in the direction substantially perpendicular to the face of the radiating element 52 and the serrated slant edges thereof. A fold structure, 55 or 57, is formed in the ground plane conductor 54 as a linear fold extending in a direction perpendicular to the face of the radiating element 52, and therefore parallel to the displaced outer peripheral edge portion 56 or 58. The angle α about which the outer peripheral edge portion, 56 or 58, is displaced away from the radiating element 52 is any suitable value not exceeding 90°. In other embodiments all peripheral edge portions (e.g. all four edges of the ground planes illustrated in FIGS. 5*a* and 5*b* may be displaced by a suitable angle a.

Figure 6A:
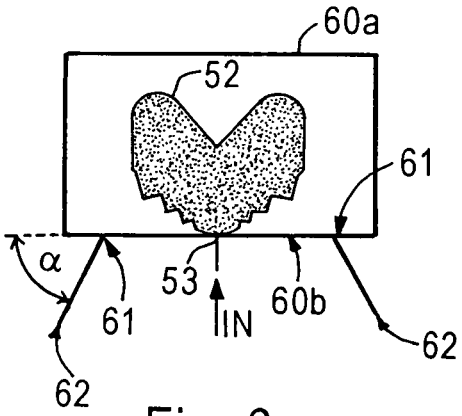
FIGS. 6*a* and 6*b* illustrate monopole antennas of a variety illustrated in FIGS. 5*a* and 5*b* respectively.
Figure 6B:
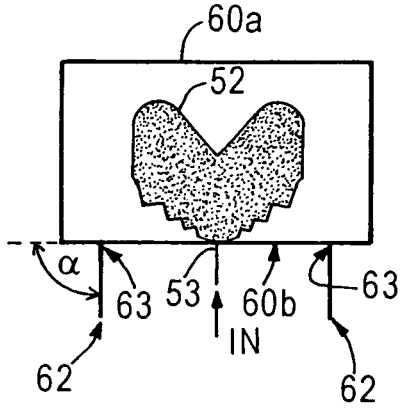

Referring to FIG. 6*a* and FIG. 6*b* there are illustrated further variants of the embodiments illustrated in FIG. 5*a* and FIG. 5*b* respectively. In these embodiments, the ground plane is additionally folded along a linear fold running parallel to the face/plane of the radiating element 52 thereby defining two separate but electrically joined planar portions, 60*a* and 60*b*, of the ground plane which are perpendicular to each other. This ground plane folding is the same as the folding 45 referred to in conjunction with FIG. 4*b*–4*d* and consequently results in the face of the radiating element 52 extending across the face of the upwardly folded portion 60*a* of the ground plane at a constant separation thereform. Consequently, the antenna embodiments illustrated in the FIG. 6*a* and FIG. 6*b* each possess a ground plane displaying three fold structures, two of which (items 61 or 63) run parallel to each other and perpendicular to the face of the radiating structure and serve to displace a peripheral edge portion of the ground plane from the view of the radiating element, while a third fold (not shown) runs perpendicular to the aforementioned two parallel folds and parallel to the plane of the radiating element 52 and serves to displace a planar portion of the ground plane 60*a* towards the face of the radiating element such that the latter extends across the former.

Figure 7:
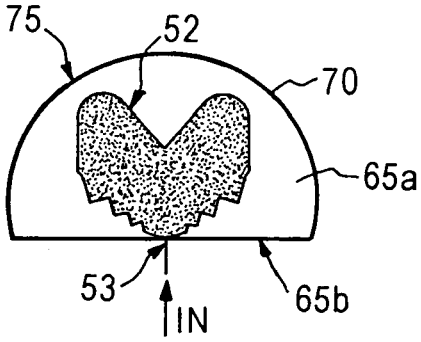
FIG. 7 shows a monopole antenna possessing a ground plane structure folded as in the antenna structure illustrated in FIG. 4*a* but with the outer peripheral edge of the portion of the ground plane conductor across which the face of the radiating element extends shaped into a semi-circular edge.

FIG. 7 illustrates a variant in the structure of the antenna illustrated in FIG. 4*a* and FIG. 4*b* in which the ground plane structure 70 of the antenna is folded along a linear fold to produce two planar ground plane parts, 65*a* and 65*b*, whereby the plane of one of the planar parts 65*b* is perpendicular to the plane of the radiating element 52 whereas the plane of the other of the planar parts 65*a* is parallel with and directly facing the plane of the radiating elements being spaced therefrom by a constant separation "x". In this variant, the outer peripheral edge 75 of the planar part of the ground plane structure across which the radiating element 52 extends is semi-circular. This shape reduces overall antenna size without any significant reduction in performance.

Thus, the present invention, for example, as shown in the above embodiments, may provide an ultra wide-band (UWB) electromagnetic impulse transceiver for applications in short range communications and/or positioning systems. The invention may be implemented in the form of a monopole antenna thereby obviating the need for a balun within the antenna circuitry. The antenna according to the present invention in any of its embodiments has the important benefit of being sufficiently small for use as a portable impulse transceiver.

Furthermore, monopole antennas structured according to the present invention in its first aspect display up to a decade of bandwidth, have reduced aperture clutter with moderate signal loss and have relatively small physical size.

Figure 8:
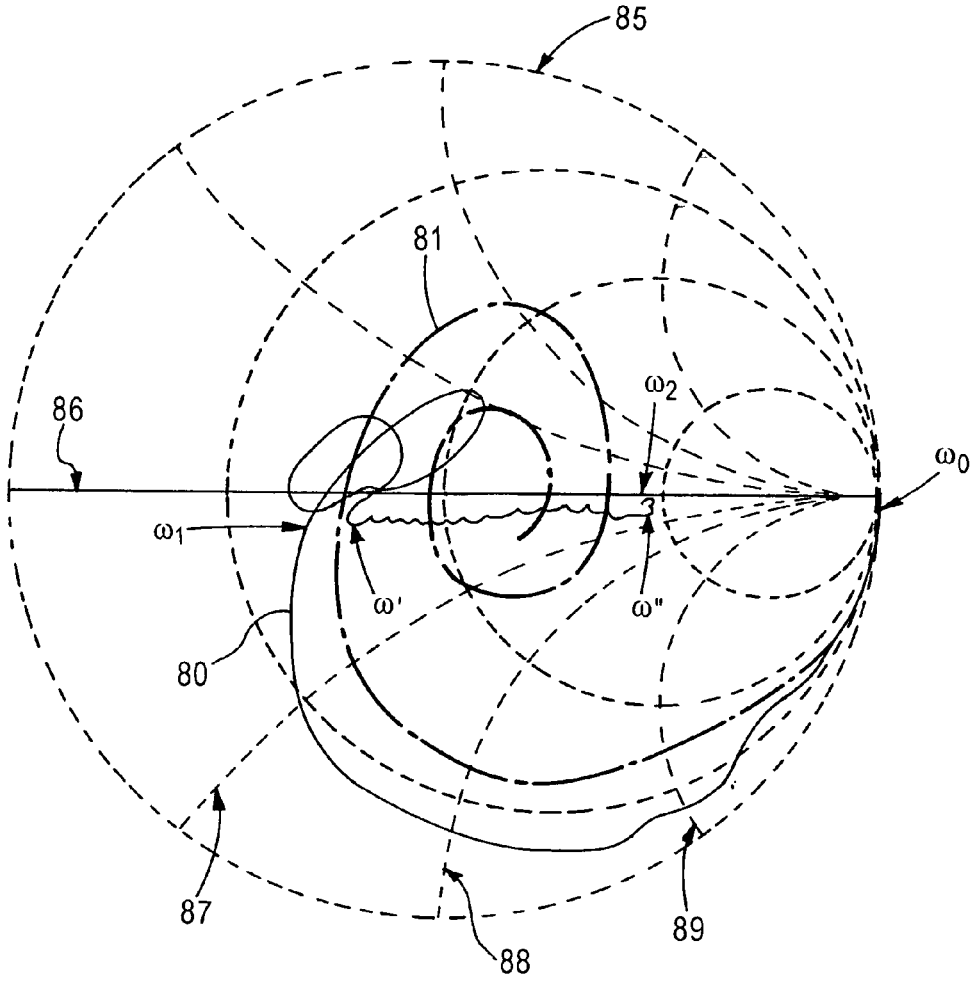
FIG. 8 illustrates a Smith Chart recording the impedance of a monopole antenna as a function of signal frequency.

FIG. 8 illustrates a Smith Chart 85 displaying the change in impedance of a monopole antenna having a radiating element possessing log-periodically scaled slant edge serrations such as is illustrated in FIGS. 1, 2*a*, 4*a*, 5*a*, 5*b*, 6*a*, 6*b* and 7.

The Smith Chart illustrates the variation in antenna impedance across a bandwidth of signal frequencies extending from $T_0$=0.045 GHZ to $T_2$=20 GHZ. Starting at near an open circuit impedance at low signal frequency $T_0$, the impedance trace 80 of the serrated radiating element in question initially follows a clockwise looping trajectory which converges towards the "zero-reactance axis" 86 of the Smith Chart in a manner similar to that expected from prior art monopole antennas.

The trajectory 81 illustrated in FIG. 8 provides a representative example of the spiralling trajectory one typically expects of prior art large diameter monopole antennas, and has been included in FIG. 8 for the purposes of comparison.

However, at an intermediate frequency value of $T_1$=3.6 GHZ the trajectory 80 of the impedance of the present monopole antenna begins to diverge from the spiralling trajectory form typically expected. As can be seen, the reactive component of the impedance begins to stabilise upon a constant value as the signal frequency increases further. Indeed, across the signal frequency range T=T' to T=T", the impedance trajectory 80 is almost completely constrained to follow a path of constant reactance (of a low value).

As is well known in the art, the nature of a Smith Chart is that the axis of the chart include circular segments such as segments 87, 88 and 89 which each separately define a locus of impedance values in which only the resistive component of the impedance changes along the line, while the reactive component remains constant. Indeed, the axis 86 represents a special case of this in which the reactive impedance component is 0.

Thus, it can be seen that the portion of the trajectory 80 located between signal frequency values T' and T" closely follows a constant reactance line of the Smith Chart just below the zero-reactance line 86. This near constancy in the reactance of the antenna greatly assists in reducing the occurrence of impedance mismatches arising within the antenna over frequency values ranging from T' to T" at least.

The antennas illustrated in FIG. 1, FIG. 3*a* to 3*c* and FIGS. 5*a* and 5*b* are "omnidirectional" being unlimited in their azimuthal direction of radiation. For a particular embodiment of this invention, it was found that the 140 degree (10 dB) elevation beamwidth extends from about −60 degrees to about +80 degrees relative to the position of the ground plane. The antenna illustrated in FIGS. 2*a* to 2*c* and 4*a* to 4*f* and FIGS. 6*a*, 6*b* and 7 show different types of "unidirectional" antenna which are designed to radiate in a specific (limited) range of directions.

It is to be understood that variants of the above described examples of the invention in its various aspects, such as would be readily apparent to the skilled person, may be made without departing from the scope of the invention in any of its aspects.

The invention claimed is:

1. An antenna, comprising:

a radiating element having a signal feed-point and two opposed slant edges which diverge with increasing distance from the antenna feed-point such that the radiating element tapers outwardly therefrom, wherein a slow-wave structure is formed in a slant edge so as to extend along the slant edge thereby to form a slow-wave structure for a signal propagating along the slant edge, wherein the slow-wave structure is shaped as a series of serrations thereby to increase the rate of radiative loss of energy from a signal propagating along the slant edge, wherein serrations in said series of serrations are of a common shape such that corresponding dimensions of successive serrations increase log-periodically whereby the ratio of said corresponding dimensions in respect of successive serrations has a constant predetermined ratio value.

2. The antenna according to claim 1, wherein one or more serrations in said series of serrations is shaped to terminate at a convergence of two tapering serration edges forming a single serration tip.

3. The antenna according to claim 1, wherein the length of an edge of any given serration of said series of serrations exceeds the length of the corresponding edge of the preceding serration of the series such that the ratio of said lengths in respect of successive serrations has a value substantially equal to said constant predetermined ratio value.

4. The antenna according to claim 1, wherein the distance between the location of the feed-point and the location of successive serrations of the series of serrations increases log-periodically whereby the ratio of the said distance in respect of successive serrations has a constant predetermined ratio value.

5. The antenna according to claim 1, wherein each one of the two opposed slant edges of the radiating element has a respective said series of serrations formed therein.

6. The antenna according to claim 1, wherein the radiating element has a distal peripheral edge bridging the terminal outermost ends of the two slant edges thereof which recedes towards the feed-point at the mid-region thereof so as to shape the radiating element into two symmetrical lobes which diverge with increasing distance from the feed-point.

7. The antenna according to claim 6, wherein the mid-region of the distal peripheral edge recedes towards the feed-point to form a V-shaped notch which extends into the radiating element with an apex angle less than 90 degrees.

8. The antenna according to claim 1, having said radiating element and a ground plane conductor relative to which the radiating element extends substantially perpendicularly thereby to form a monopole antenna.

9. The antenna according to claim 1 having said radiating element and a ground plane conductor across which a face of the radiating element extends thereby to form a monopole antenna.

10. The antenna according to claim 8, wherein the ground plane is shaped to include two separate planar parts joined in the ground plane structure, whereby the radiating element is arranged to extend substantially perpendicularly relative to one of the two planar parts of the ground plane and a face of the radiating element is arranged to extend across the other of the two planar parts thereof.

11. The antenna according to claim 10, wherein the face of the radiating element is substantially parallel to the plane of the other of the two planar parts of the ground plane.

12. The antenna according to claim 10, wherein the face of the radiating element is other than parallel to the plane of the other of the two planar parts of the ground plane, such that the separation between the radiating element and the part of the ground plane across which a face of the radiating element extends varies with increasing distance from the feed-point.

13. The antenna according to claim 8, wherein said ground plane defines a ground plane surface which includes: a substantially planar central surface portion arranged nearmost the radiating element to face the radiating element; and, an outersurface portion which contains a peripheral part of the ground plane surface, wherein the outer surface portion extends away from the central surface portion so as to be non-coplanar therewith and to face generally away from the radiating element.

14. The antenna according to claim 13, wherein said outer surface portion extends away from the central surface portion at an angle of no more than 90° relative to the plane of the central surface portion.

15. A portable impulse transceiver apparatus comprising an antenna according to claim 1.

16. An ultra wide-band (UWB) communications apparatus comprising an antenna according to claim 1.

17. The antenna according to claim 9, wherein the ground plane is shaped to include two separate planar parts joined in the ground plane structure, whereby the radiating element is arranged to extend substantially perpendicularly relative to one of the two planar parts of the ground plane and a face of the radiating element is arranged to extend across the other of the two planar parts thereof.

* * * * *